US006543710B2

(12) United States Patent
Konetzka et al.

(10) Patent No.: US 6,543,710 B2
(45) Date of Patent: Apr. 8, 2003

(54) SEPARATOR MILL

(75) Inventors: Georg Konetzka, Augsburg (DE); Hermann Eder, Welden (DE)

(73) Assignee: Hosokawa Alpine Aktiengesellschaft & Co. OHG, Augsburg (DE)

( * ) Notice: Subject to any disclaimer, the term of this patent is extended or adjusted under 35 U.S.C. 154(b) by 0 days.

(21) Appl. No.: 09/901,395

(22) Filed: Jul. 9, 2001

(65) Prior Publication Data

US 2002/0011534 A1 Jan. 31, 2002

(30) Foreign Application Priority Data

Jul. 11, 2000 (DE) ..... 100 33 628

(51) Int. Cl.[7] ..... B02C 19/06
(52) U.S. Cl. ..... 241/39; 241/79.1; 241/285.2
(58) Field of Search ..... 241/1, 5, 39, 40, 241/79.1, 285.2

(56) References Cited

U.S. PATENT DOCUMENTS

| | | | | |
|---|---|---|---|---|
| 4,018,388 A | * | 4/1977 | Andrews | 241/39 |
| 4,133,488 A | * | 1/1979 | Heinemann et al. | 241/107 |
| 4,602,743 A | | 7/1986 | Nied | |
| 6,398,139 B1 | * | 6/2002 | Nied | 241/39 |

FOREIGN PATENT DOCUMENTS

| | | | | |
|---|---|---|---|---|
| DE | 3140294 A1 | | 4/1983 | |
| DE | 3338138 A1 | | 5/1985 | |
| DE | 4100338 A1 | | 7/1992 | |
| JP | 161257 | * | 6/1992 | 241/5 |
| JP | 15193 | * | 1/1994 | 241/5 |

* cited by examiner

*Primary Examiner*—John M. Husar
(74) *Attorney, Agent, or Firm*—Martin Fleit; Paul D. Bianco; Fleit Kain Gibbons Gutman & Bongini P.L.

(57) ABSTRACT

Fluidized-bed opposed jet mills, configured as separator mills, and provided with easy accessibility so that the interior space can be easily cleaned with little effort. The separator wheel is formed together with the bearing unit and the actuator unit as one component, which is detachably attached to the grinding container and can be moved relative to the grinding container by kinematic devices in such a manner that the separator wheel can be removed from the grinding container upward through the discharge outlet for finely ground material, while the discharge device for the finely ground material remains connected to the grinding container. In this manner, the separator mill can be easily assembled and disassembled by the user and the separator mill becomes easily accessible for thorough cleaning. This is particularly advantageous when the material to be ground is changed frequently, as is the case in the pharmaceutical and chemical fields.

9 Claims, 7 Drawing Sheets

SEPARATOR MILL

BACKGROUND OF THE INVENTION

1. Field of the Invention

The invention relates to a separator mill, and more particularly, fluidized-bed opposed jet mills configured as separator mills, and to the arrangement of components therefore.

2. Description of the Prior Art

Fluidized-bed opposed jet mills generally consist of a cylindrical grinding container set on a vertical axis, wherein gas jets are provided in the lower part of the grinding container. These gas jets are directed in opposite directions in such a manner that the material to be ground in the grinding container is sucked into the airflow and accelerated by the airflow so that the material is crushed on impact as the particles of the material to be ground collide with each other.

In order to remove already-ground fine material from the mill, while leaving material that has not yet been sufficiently ground in the mill, the upper part of the grinding container contains a separating device. The separating device is usually embodied as a separator that uses centrifugal force, wherein the particles that are smaller than the critical separation size are transported inward into the rotating bucket wheel of the separator and separated in this manner, while the particles that are larger than the critical separation size are thrown off the rotating bucket wheel and remain inside the grinding container.

This type of a separator mill is known, e.g., from DE 33 38 138 C2. It is embodied as a fluidized bed jet mill with a grinding chamber that is free of fixtures for directing the gas jets used for the grinding process, wherein a nozzle with a gas jet that is ejected vertically upward and that is used both to grind and to fluidize the material to be ground in the grinding chamber is provided in the bottom area of the grinding chamber. The grinding chamber is completely filled with material up to a level so that material to be ground and gas exit from the bed of material as a slow speed column. This column is used to feed a separator, which is located above the surface of the bed of material and operates independent of the jet emerging from the bottom nozzle.

In this arrangement, a certain number of additional jet nozzles that open towards the bed of material are positioned below the surface of the bed of material. The openings of these nozzles are distributed around a circle that is coaxial with the axis of the bottom nozzle and within a plane that is perpendicular to the axis of the bottom nozzle. The axes of these nozzles intersect each other at a point on the axis of the bottom nozzle below the plane of the nozzle openings.

The separating device in this design is located in the upper part of the grinding container and rotates about a vertical axis. The separator wheel operates based on the principle of centrifugal force and separates material that has been ground sufficiently fine from the material to be ground and discharges it from the grinding container via a finely ground material discharge opening arranged above the separator wheel. Furthermore, a mounting and driving device for the rotating separating wheel is positioned above the discharge opening for finely ground material.

Conventional fluidized bed opposed jet mills have an overall structure of the grinding container and an arrangement of the corresponding components that are designed entirely in consideration of industrial engineering conditions. However, there is a growing demand for machines designed according to industrial engineering conditions which can also be easily assembled and disassembled by the user and which must be easily accessible for thorough cleaning.

This is especially true for the pharmaceutical industry and for toner production wherein production is based on batch production. Only small amounts of product are ground, and then, shortly thereafter, entirely different products are ground in the same mill. For example, when changing to a toner product of a different color, or when switching between pharmaceutical products with different effects, it is absolutely mandatory to clean the entire machine thoroughly so that residual amounts of the previous product will not contaminate the next product to be ground.

Cleaning of conventional separating mills is complicated and time consuming. In particular, there is a high risk that there will still be small residual amounts of the previous product in the machine even after cleaning.

SUMMARY OF THE INVENTION

It is therefore the task and object of the invention to improve a fluidized-bed opposed jet mill with a separator so that it is easily accessible and it can be cleaned in a simple manner and without much effort. This task is solved, and object is achieved, by the apparatus of the present invention. Further additional and advantageous embodiments can be apparent from the following detailed description of the present invention.

The fluidized-bed opposed jet mill according to the invention provides a separator arrangement that forms one component from the mounting device and the actuator and that is attached to the grinding container in a detachable manner. In this arrangement, the component can move relative to the grinding container by means of kinematic devices, in such a way that the separator wheel can be removed from the grinding container upwards through the discharge opening for the finely ground material. The discharge opening for the finely ground material remains attached to the grinding container.

DETAILED DESCRIPTION OF PREFERRED EMBODIMENTS OF THE INVENTION

Figure 1:
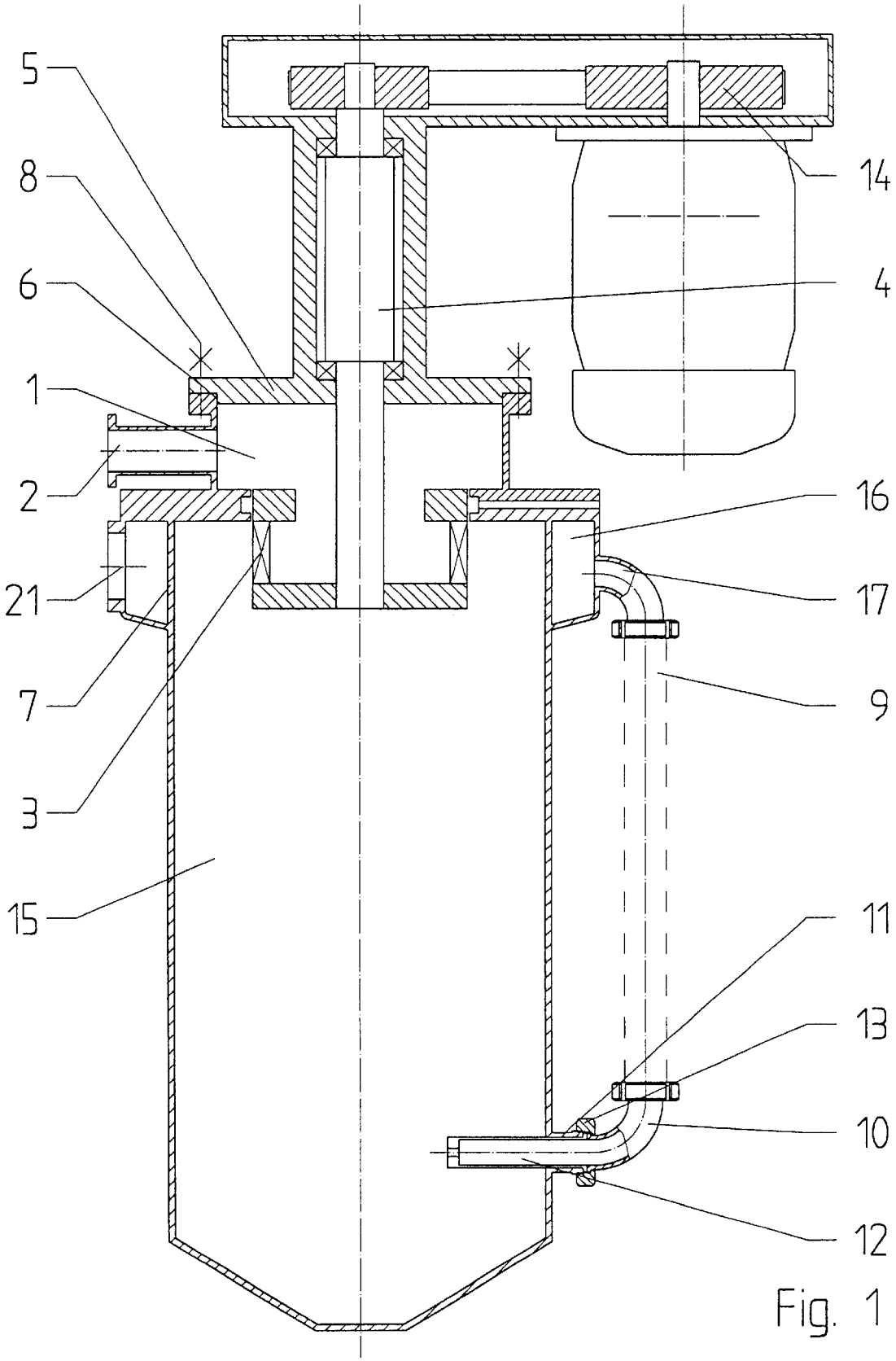
FIG. 1 shows a cross-sectional view of the fluidized-bed opposed jet mill according to the invention.

As explained above, the fluidized-bed opposed jet mill according to the invention provides a separator arrangement that forms one component from the mounting device and the actuator and that is attached to the grinding container in a detachable manner. In this arrangement, the component can move relative to the grinding container by means of kinematic devices, in such a way that the separator wheel can be removed from the grinding container upwards through the discharge opening for the finely ground material. The discharge opening for the finely ground material remains attached to the grinding container.

Thus, the grinding container is not disassembled and made accessible in a plane between the lower part containing the grinding area, and the upper part containing the separator, but instead the separating plane is located within the area of the separator. This not only has the advantage that the grinding area is fully accessible, but also that the separator becomes accessible from the outside as well as from the inside.

According to the invention, by separating the separator from the grinding container, both the separator wheel and the interior of the finely ground material discharge space, as well as the shaft of the separator wheel, become freely accessible.

Since the discharge of the finely ground material and its routing still remain connected with the grinding container, it is not necessary to disconnect supply lines in order to open and access the grinding container.

In a preferred embodiment, the separator wheel can be swiveled through 180°, making the separator wheel and the grinding container optimally accessible and easy to clean. The swiveling of the separator wheel is accomplished by means of a kinematic device that first displaces the separator wheel together with the mounting device and the actuator vertically upwards and then rotates it by an angle greater than 90°, preferably 180°, about an axis in the horizontal plane. In an ideal case, the axis of rotation passes right through the center of gravity of the component consisting of separator wheel, mounting device and actuator unit.

This opening principle can be advantageous, not only in fluidized-bed opposed jet mills, but also in, e.g., impact crushers with a rotating beater device. In such an arrangement, the beater device replaces the function of the separator wheel, and at the level of the beater device, the container wall has interior impact ribs or grinding tracks around the circumference of the housing. The area with connecting lines above the rotating beater device is used to supply the material to be ground.

In a further embodiment variant of the invention, the circular line that distributes the grinding air to the connections of the individual jet nozzles is positioned above the jet nozzles, preferably at the level of the separator wheel. This arrangement prevents contamination of the circular grinding-air line by product dust. In jet mills according to the state of the art, lines carrying grinding air are positioned at the same level as the jet nozzles or below them, resulting in ground material being sucked into the grinding-air line through reverse flow. In order to facilitate access to the nozzles, according to the invention, the connecting pieces of the flexible hose lines on the circular grinding-air line are positioned offset relative to the connections to the nozzles. This offset arrangement is implemented in such a manner that, when the connecting pieces are detached from the nozzles, the hoses assume a vertical position as a result of gravity moving the disconnected connecting pieces laterally away from the nozzles. In this manner, the nozzle and the nozzle mount on the grinding container become easily accessible for cleaning purposes.

The number of separating planes has been minimized for easy cleaning of the interior surfaces of the grinding container. The required welding seams have been moved to locations that are less likely subject to product deposition and are accordingly also easier to clean. Thus, according to the invention, the corner welding seam in the transitional areas of the cylindrical container wall and the conical bottom has been replaced by a corresponding plane welding seam on the vertical grinding container wall and on the conical wall of the bottom. In addition, an annular mounting plate is welded between grinding container wall and bottom. This plate features a transitional contour with a long radius so that material cannot attach itself and so that it is easy to clean.

The foregoing will become more evident from the following detailed explanation of the embodiment forms, examples.

FIG. 1 shows discharge area 1 for ground material. Discharge opening 2 is formed in this area at a position between separating wheel 3 and separating wheel bearing 4. Separating wheel 3, together with separating wheel bearing 4 and actuator unit 14, form a component which, by means of a bearing flange 5, is attached via bolts 8 to mill 15 in a detachable manner. Bearing flange 5 forms a tight seal for discharge area 1 for the ground material. Bearing flange 5 is centered relative to mill housing 7 by means of centering adapter 6.

Figure 5:
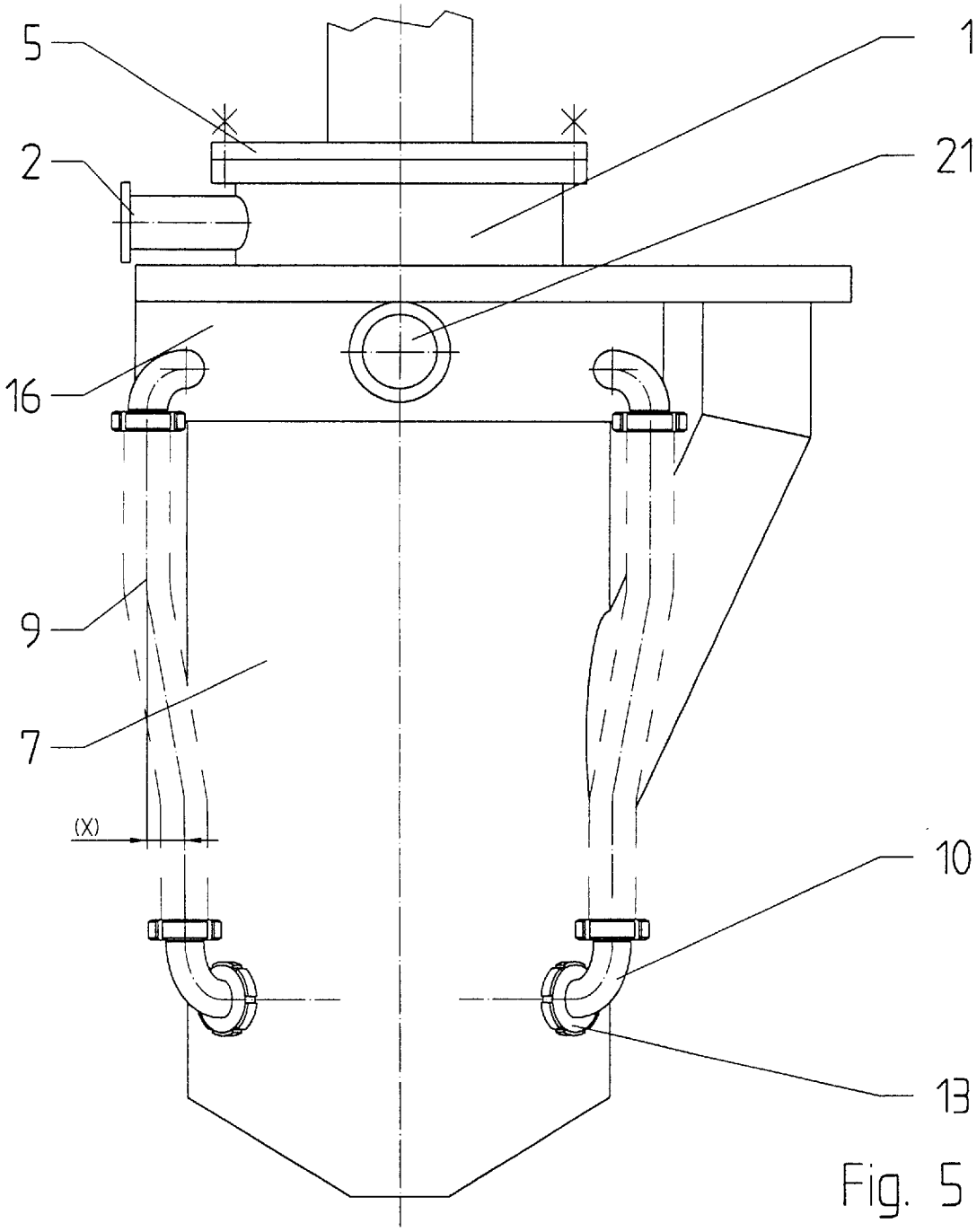
FIG. 5 shows a view of the offset arrangement of the grinding air connections.

Circular grinding-air line 16 is mounted on the outside of mill housing 7 at the level of separator wheel 3. Around the circumference of circular grinding-air line 16 there are several connections 17 connected to elastic pressure hoses 9. Pressure hoses 9 conduct the pressurized air fed into them via circular grinding-air line 16 and connections 21 to each individual jet nozzle 12. Pressure hoses 9 are connected detachably to jet nozzles 12 via additional connecting pieces 10. Upper connecting pieces 17 are arranged around the circumference at an offset to lower connecting pieces 10, so that, when threaded connection 13 on connecting pieces 10 is disconnected, pressure hoses 9 swivel into a vertical position due to gravity, which frees the input openings to jet nozzles 12 (see also FIG. 5).

Figure 2:
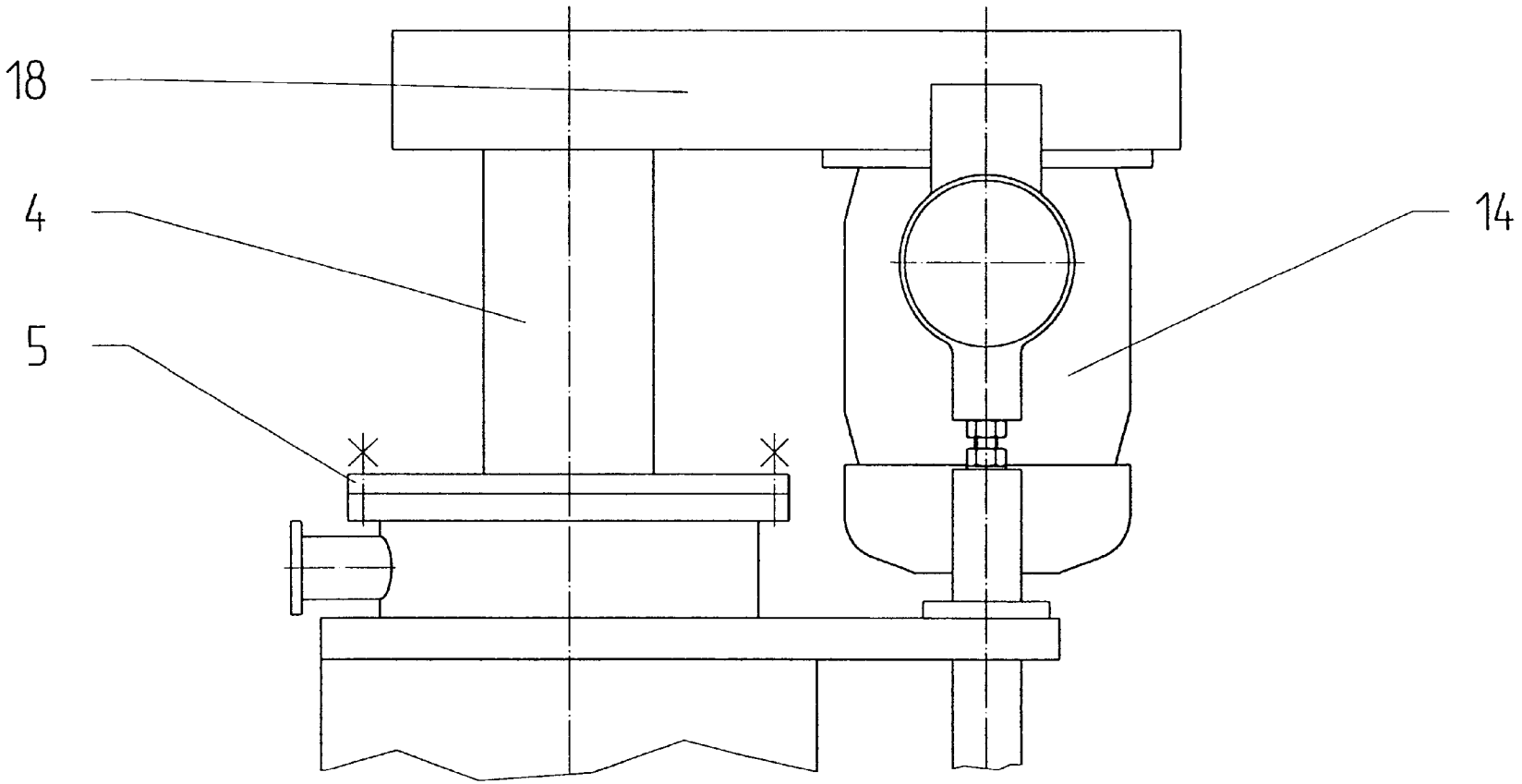
FIG. 2 shows the component consisting of separator wheel, mounting device and actuator unit in the closed state.

In FIG. 2 the component consisting of bearing flange 5, bearing 4 and actuator unit 14 is shown in a closed state. Belt actuator 18 connects actuator unit 14 to bearing 4 and converts the rotations of actuator unit 14 to an RPM that is suitable for the separation wheel.

Figure 3:
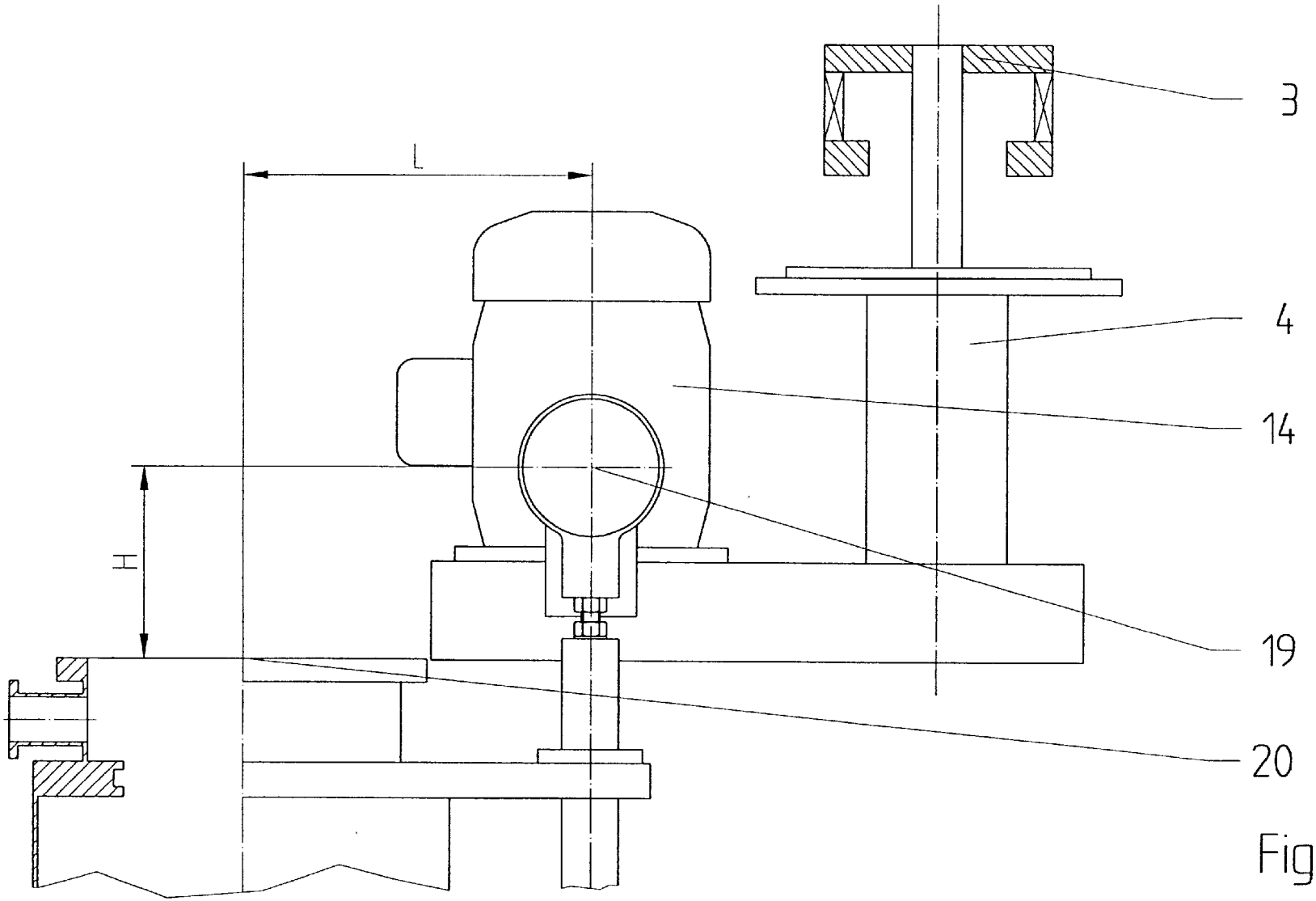
FIG. 3 shows the component consisting of separator wheel, mounting device and actuator unit in the opened state in the 180° position.

The swiveling device shown in FIG. 3 makes it possible for the component consisting of separating wheel 3, bearing 4 and actuator unit 14 to swivel 180° about axis of rotation 19. The axis of rotation of separating wheel 3 is then oriented in a vertical direction and separation wheel 3 is accessible in a position that permits access from the top. The distance L and H of axis of rotation 19 from the center of cleaning opening 20 is selected to keep cleaning opening 20 completely unobstructed so that the inside area is easily accessible.

Figure 4:
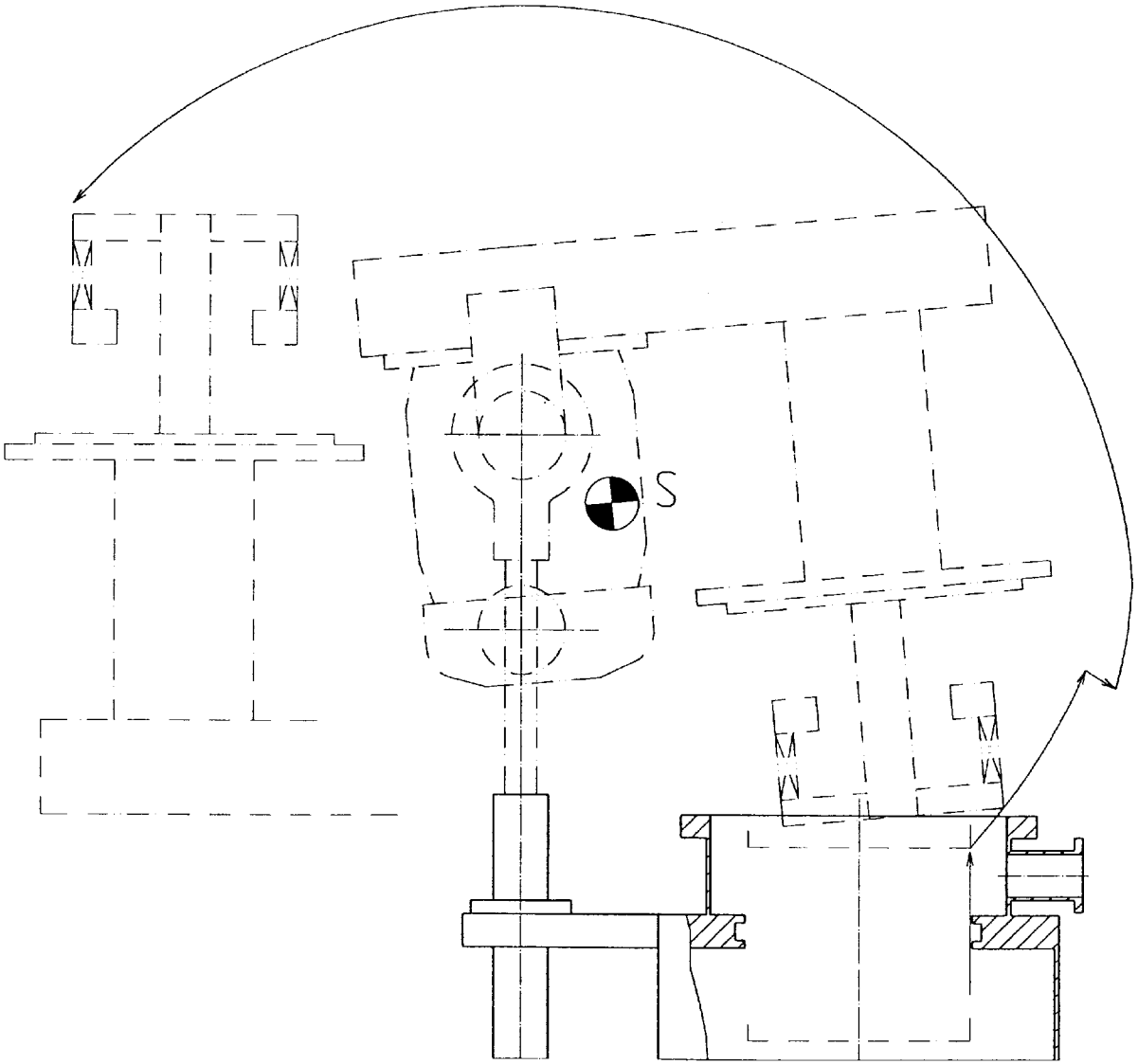
FIG. 4 shows an opening sequence of the kinematic device according to the invention.

The opening process according to FIG. 4 is controlled in such a manner that the rotating actuator and the vertical actuator of the swiveling device can be moved simultaneously. The axis of rotation of the swiveling device is preferably located as close as possible to the center of gravity.

Figure 6:
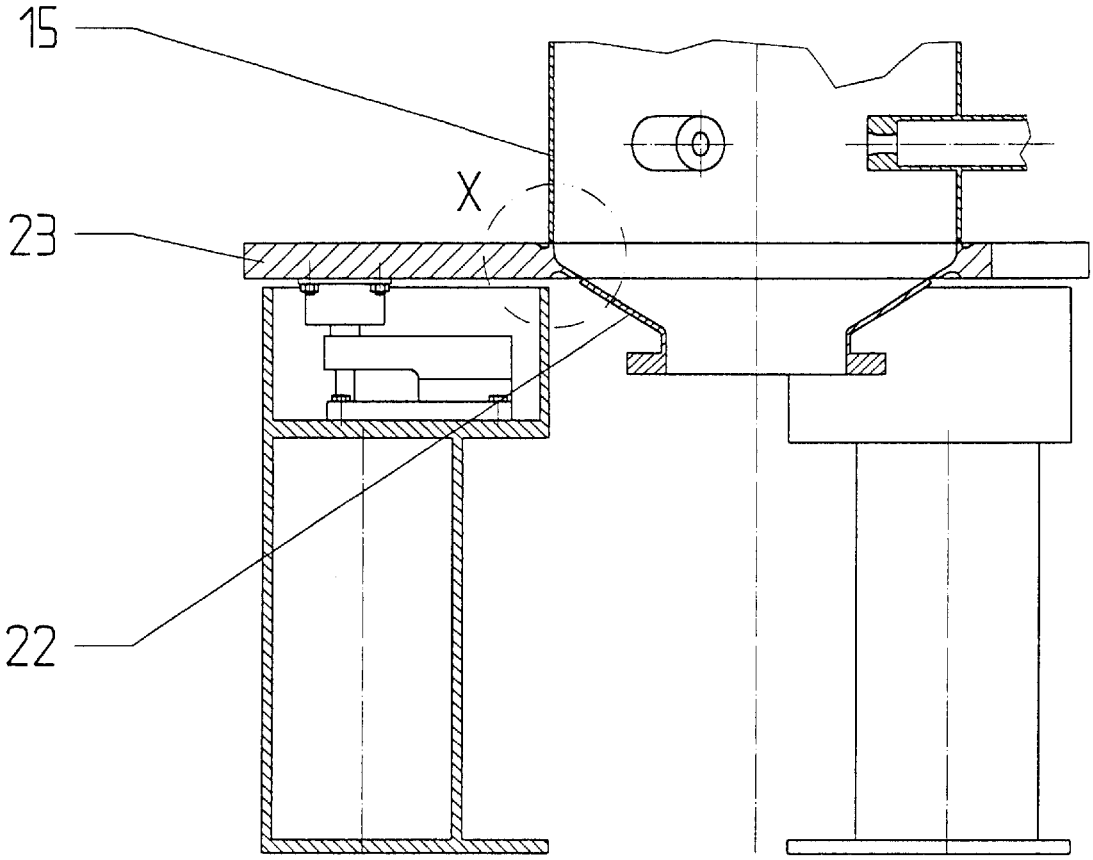
FIG. 6 shows the mounting plate according to the invention.
Figure 6:
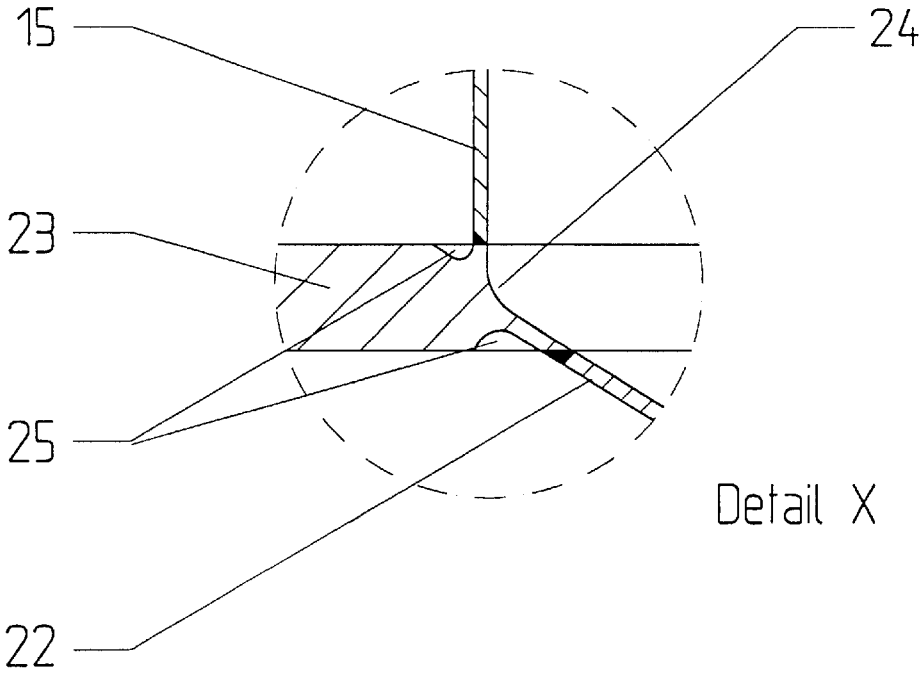

In FIG. 6, a mounting plate 23 is provided in the transition between the cylindrical grinding container wall of mill 15 and the conical grinding container bottom 22. This plate is rounded in the transition 24 at the interior radial edge. In order to achieve a transition from grinding container wall to conical grinding container bottom 22 that is favorable to welding, recesses 25 are formed in the top and bottom side of mounting plate 23, wherein these recesses extend in a circular direction around mill 15 and reduce mounting plate 23 to the required wall thickness of the grinding container wall.

Figure 7:
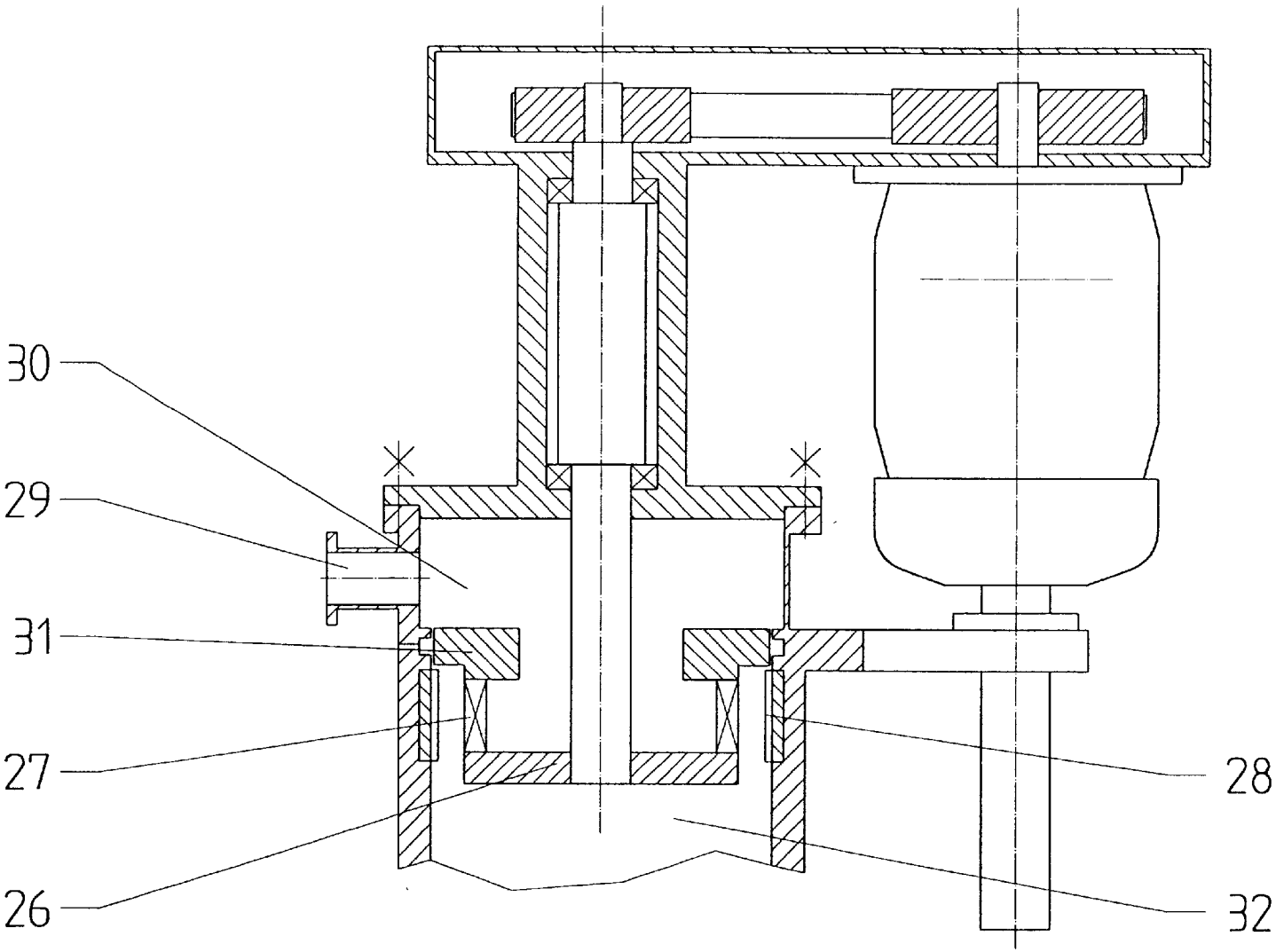
FIG. 7 shows the opening principle according to the invention in an impact crusher.

According to FIG. 7, the component according to the invention can also be used in beater mills. For this purpose, rotating part 26 is equipped with impact beaters 27 that interact with a grinding track 28 that is attached to the interior circumference of the grinding container. The material to be ground is fed into distribution area 30 in this arrangement via inlet 29, and from here the material to be ground is distributed onto impact beaters 27. The sealing 31 of the functional areas is done between distribution area 30 and grinding area 32.

Although the invention has been shown and described in terms of preferred embodiments, changes and modifications will be evident to those skilled in the art from the teachings herein. Such changes and modifications that do not depart from the spirit, scope and teachings of the invention are deemed to fall within the purview of the invention as claimed.

What is claimed is:

1. Fluidized-bed opposed jet mill comprising:

a grinding container for the holding material to be ground and having a top opening, a number of inward-directed opposed jet nozzles located in the lower part of the grinding container and oriented in such a manner that the jets meet at a common point for the grinding and fluidization of the material to be ground in the grinding container, a separating device located in the upper part of the grinding container having a separating wheel that rotates about a vertical axis and that functions based on the principle of centrifugal force for the separation of material that has been ground sufficiently fine, a discharge for finely ground material located above the separating wheel for the purpose of discharging the separated and sufficiently finely ground material from the grinding container, a bearing defining a closure located vertically above and operatively connected to drive the rotating separating wheel, a detachable connection detachably connecting the closure to the grinding container to close the top opening, an actuating unit operatively connected to drive the bearing, the separating wheel, bearing including the closure and the actuating unit constituting an integral movable component, and a swivel device connected to the actuating unit to swivel about an axis such that when the detachable connection is detached, the swivel device can move the separating wheel, bearing including the closure and the actuating unit as an integral movable component upwardly out of the top of the grinding container and then rotate to expose both the separating wheel and the top opening of the grinding container for servicing.

2. Fluidized-bed opposed jet mill according to claim 1, wherein the swivel device is comprised of a lifting device for effecting vertical lifting and a rotating device for rotating about the axis.

3. Fluidized-bed opposed jet mill according to claim 2, wherein the lifting device is a hydraulic cylinder and the rotating device is a hydraulic motor.

4. Fluidized-bed opposed jet mill according to claim 1, wherein the axis is located at the center of gravity of the combined bearing unit and the actuator unit.

5. Fluidized-bed opposed jet mill according to claim 1, wherein the swivel device is enabled for swiveling through 180°.

6. Fluidized-bed opposed jet mill according to claim 1, wherein the swivel device is enabled for swiveling the integrated movable component to clear the top opening sufficiently and leave it completely unobstructed.

7. Fluidized-bed opposed jet mill according to claim 1, further including a circular grinding-air line mounted on the grinding container above the jet nozzles at the level of the separating wheel.

8. Fluidized-bed opposed jet mill according to claim 7, wherein a plurality of grinding air connections couple the circular grinding-air line to the jet nozzles, and wherein the coupling of the grinding air connections to the circular grinding-air line, around the circumference of the circular grinding-air line, are offset relative to the coupling of the grinding air connections to the jet nozzles.

9. Fluidized-bed opposed jet mill according to claim 1, wherein the grinding container includes a cylindrical grinding container wall and a conical grinding container bottom, and wherein a mounting device is provided that is rounded in the transition at its interior radial edge and that is welded flush with the cylindrical grinding container wall and with the conical grinding container bottom.

* * * * *